US005447488A

United States Patent [19]

Horikiri

[11] Patent Number: 5,447,488

[45] Date of Patent: Sep. 5, 1995

[54] DECORATIVE PLATE PRODUCING METHOD

[75] Inventor: Yataro Horikiri, Tokyo, Japan

[73] Assignee: Sakura Hobby Craft Co., Ltd., Tokyo, Japan

[21] Appl. No.: 142,567

[22] Filed: Oct. 28, 1993

[30] Foreign Application Priority Data

Dec. 14, 1992 [JP] Japan ..... 4-332877
Sep. 29, 1993 [JP] Japan ..... 5-242400

[51] Int. Cl.[6] ..... A63D 71/00
[52] U.S. Cl. ..... 493/344; 493/379; 493/480; 434/81; 29/450
[58] Field of Search ..... 493/344, 350, 363, 379, 493/390, 392, 480, 955, 959; 428/67, 120; 29/450, 451; 283/117; 434/81, 83

[56] References Cited

U.S. PATENT DOCUMENTS 1,549,418 10/1924 Hoch ..... 283/117
2,860,555 12/1955 Williamson ..... 493/363
2,982,042 4/1958 Gick ..... 428/67

FOREIGN PATENT DOCUMENTS 2522272 9/1983 France ..... 434/83
49-25865 7/1974 Japan ..... 493/379
0030441 1/1990 Japan ..... 29/450

*Primary Examiner*—Bruce M. Kisliuk
*Assistant Examiner*—Christopher W. Day
*Attorney, Agent, or Firm*—Keck, Mahin & Cate

[57] ABSTRACT

A method of producing a decorative plate is provided, in which a substrate of a foamed plastic plate is prepared, and slits of a predetermined pattern are formed. Then, the slits are widened for firmly receiving a flexible thin tape to form a predetermined pattern.

2 Claims, 5 Drawing Sheets

DECORATIVE PLATE PRODUCING METHOD

BACKGROUND OF THE INVENTION

1. The Field of the Invention

The present invention relates to a three-dimensional decorative plate which is produced by forcibly inserting a predetermined leaves of paper, wood or metal into slits of predetermined figures and shapes on substrate of a plastic material.

2. Description of the Prior Art

In a conventional method of producing a decorative plate, leaves of paper or metal are inserted by skilled professionals, and this is not suitable for mass production or for children.

SUMMARY OF THE INVENTION

An object of the present invention is to provide an improvement in the method of producing a decorative plate which is adaptable to mass production.

A further object of the present invention is to provide a new method of producing a decorative plate which can be produced easily by children.

According to the present invention, there is provided a method of producing a decorative plate, comprising:

preparing a substrate of a foamed plastic plate, providing slits of a predetermined figure for forming a three-dimensional pattern, widening an opening of the slits, and inserting a flexible thin tape member into the slits of the predetermined pattern to thereby permit the tape member to be held by the slit so that the tape member is partly engaged within the slit and the remaining portion of the tape member extends above a plane of the substrate.

In the present invention, the flexible thin tape member preferably has an extending portion extending along a length of the tape member so that only the extended portion is inserted into and held by the slit.

In the present invention, the flexible thin tape member is inserted into the slit of the predetermined figure and pattern so that the tape member is extended upright above the surface of the substrate. Thus, a predetermined three-dimensional pattern is formed. If one extending portion of the tape member is inserted into one slit while the other extending portion thereof is inserted into the other slits so as to bridge the slits, the tape member is curved above the plane of the substrate to thereby form a curved extended portion for three-dimensional patterns.

DETAILED DESCRIPTION OF THE INVENTION

Figure 1:
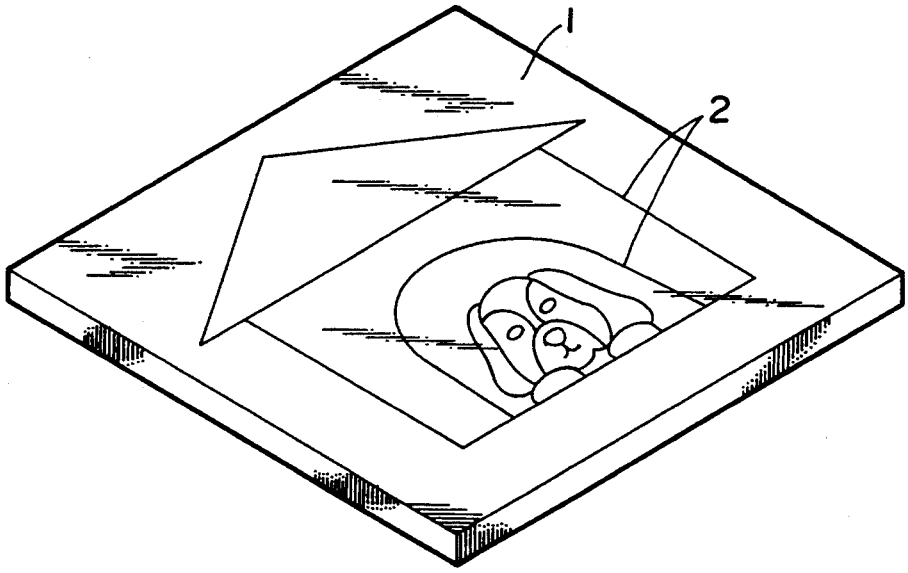
FIG. 1 is a perspective view of a substrate showing that slits of a predetermined pattern are formed on the substrate.
Figure 2:
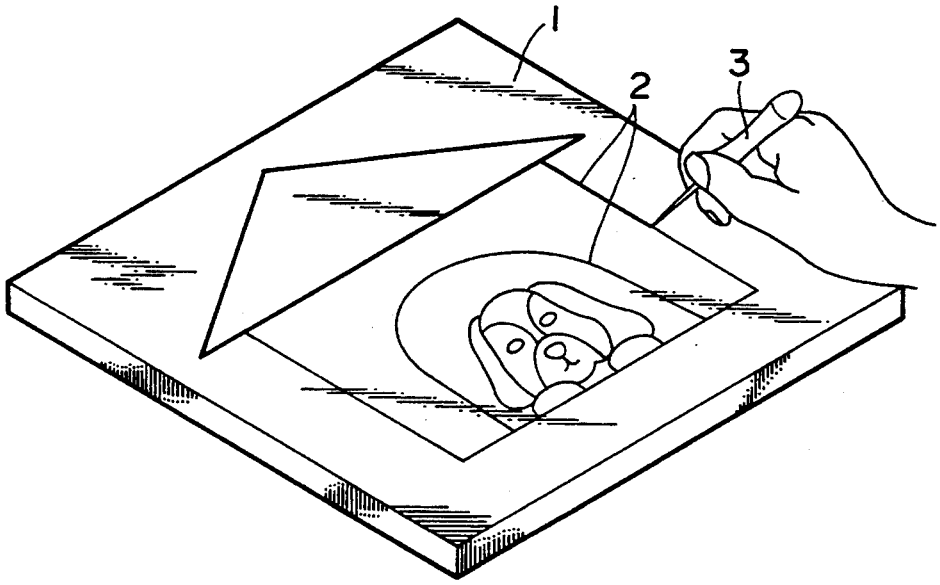
FIG. 2 is perspective view of the slitted substrate showing that the slits are widened by using a stiletto.

Referring first to FIG. 1, a substrate 1 of a foamed polystyrene plate of about 6.0 mm thick is used. Slits 2 of predetermined figures and patterns, a pattern of a dog in a kennel in the illustrated embodiment of FIG. 1, are formed on the surface of the foamed substrate by means of a suitable cutting device. The slits 2 can be formed by a cutting die of a predetermined pattern by using a cutting die to cut into a pattern which was formed by adhering a colored paper of the predetermined pattern.

After the slits 2 are formed, a stiletto 3 having a tapered point is used to move within the slits 2 along the length thereof so that the slits 2 are resiliently widened.

Figure 3:
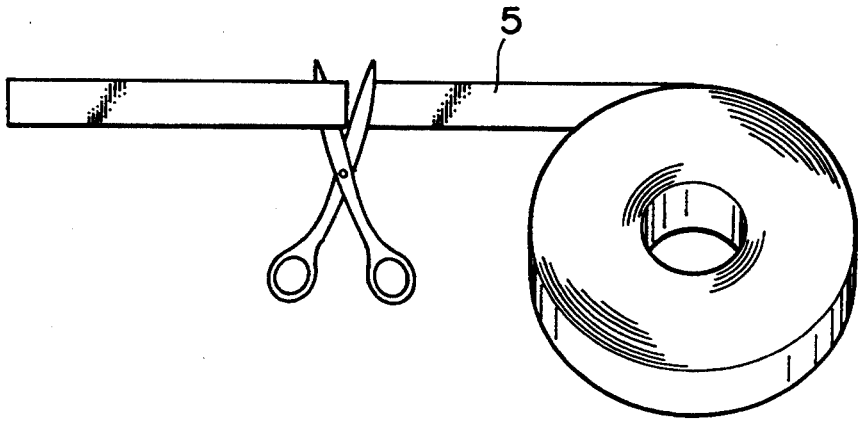
FIG. 3 shows a flexible thin tape member which is cut to a predetermined length.
Figure 4:
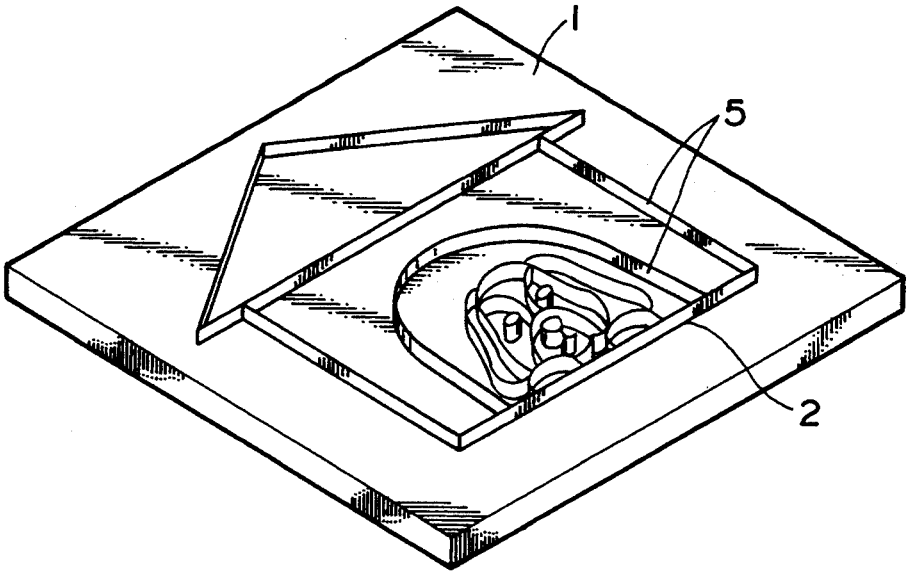
FIG. 4 is a perspective view of the substrate showing that the cut flexible thin tape member is partly inserted into the widened slit of the substrate.

Then, a flexible thin tape member 5, which was cut to a predetermined length as shown in FIG. 3, is inserted partly into the slits 2 so that about a half of the width of the tape member 5 extends above the surface of the substrate 1 as shown in FIG. 4. Since the slits 2 are widened at this moment, the insertion of the tape member 5 into the slits 2 can be conducted easily. By completion of the insertion of the tape member 5 with the tape member being extended upright above the substrate surface, the predetermined pattern confined by the inserted tape member 5 is formed and then the widened slits are returned to the unwidened position by the plastic deformation of the foamed plastics, so that the inserted portions of the tape member are firmly held by the returned wall of the slits 2 to prevent the tape member 5 from being released easily and accidentally. Two tapes of different colors or otherwise a tape of different colors on the opposite sides can be used to give multicolored impression. Further, the substrate 1 which is planar form in the illustrated embodiment can be modified to any other desired shape such as box-shaped configuration.

Figure 5:
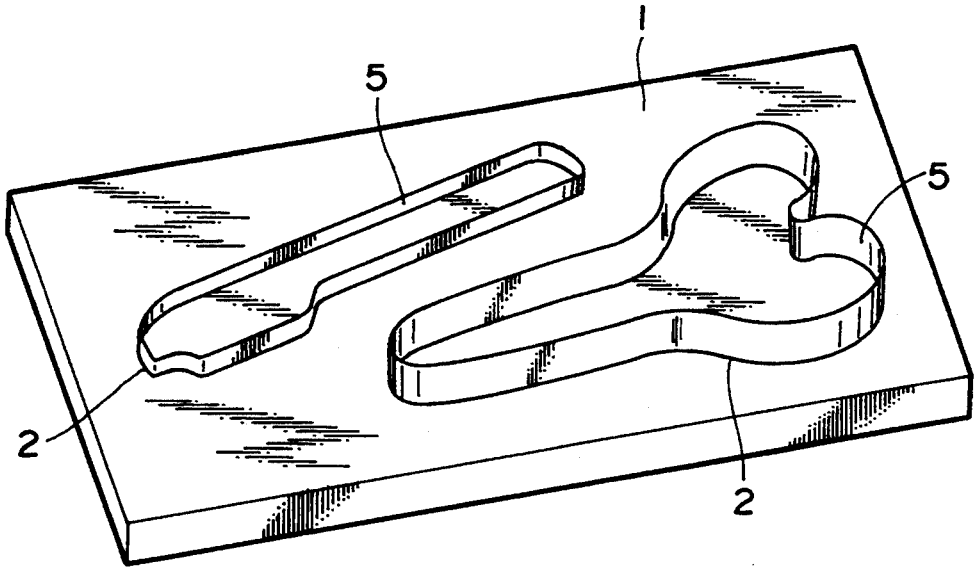
FIG. 5 is a perspective view of another decorative plate produced by the method of the present invention showing another pattern.
Figure 6:
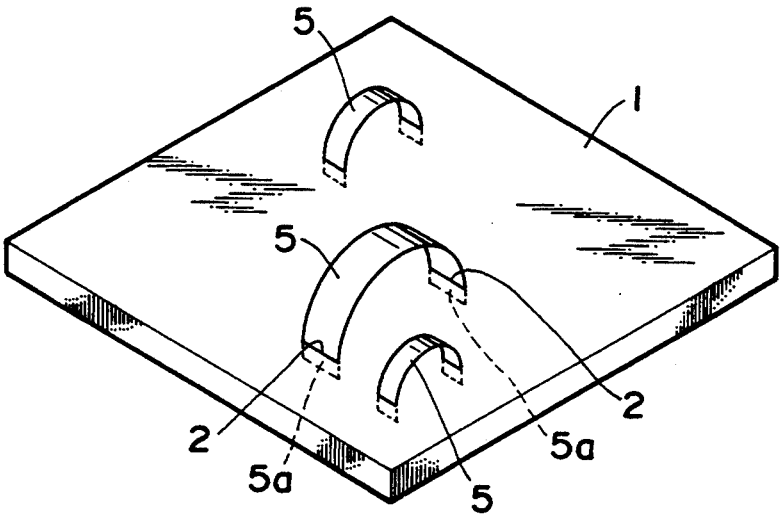
FIG. 6 is a perspective view of a further decorative plate produced by the method of the present invention showing a further pattern.
Figure 7:
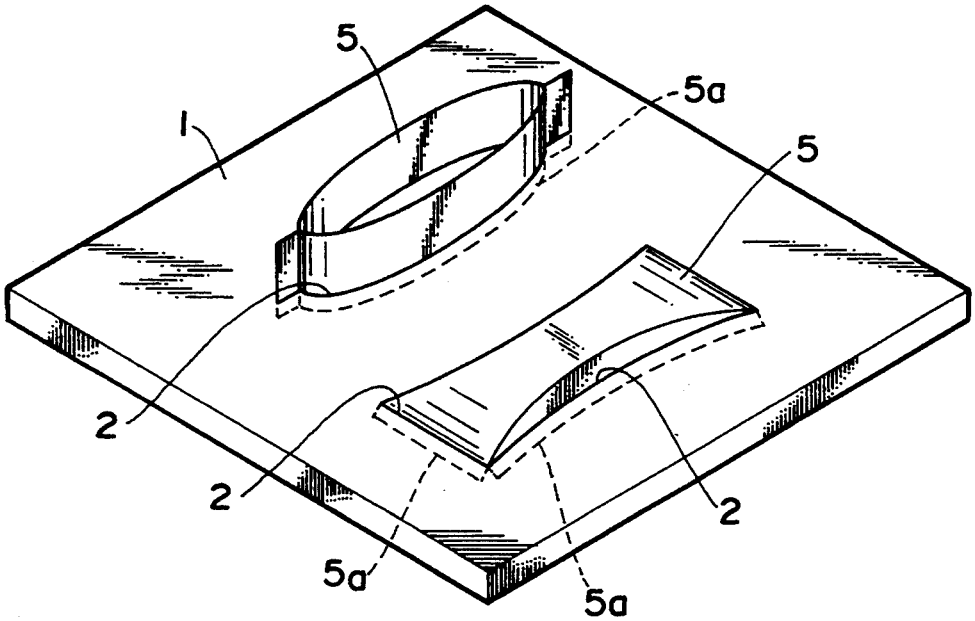
FIG. 7 is a perspective view of a further decorative plate produced by the method of the present invention showing a further pattern.
Figure 8A:
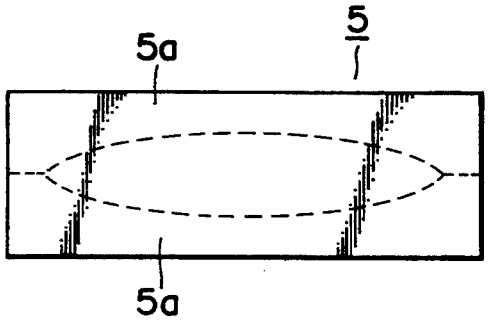
FIGS. 8A and 8B are plan views of a flexible thin tape member shown in FIG. 7.
Figure 8B:
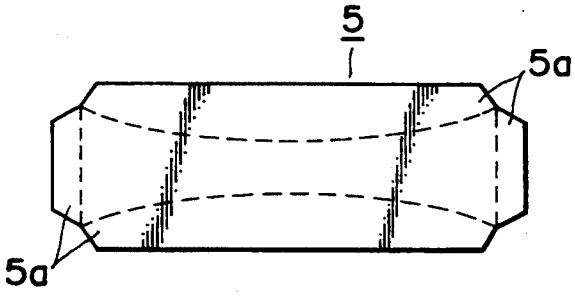
Figure 9:
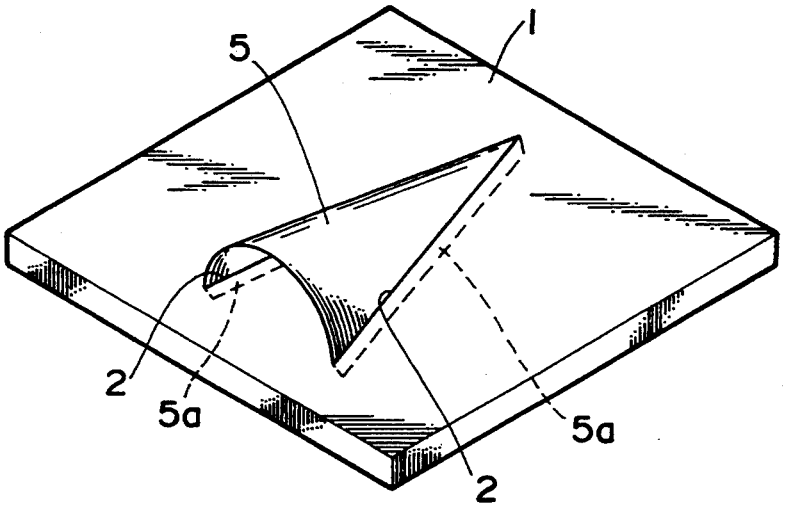
FIG. 9 is a perspective view of another decorative plate produced by the method of the present invention showing another pattern.

FIG. 5 shows another embodiment in which the patterns are made by forming slits 2 which are made by running a cutter along a contour of a pair of scissors and a ballpoint pen. As similar as the previous embodiment the slits are widened and a flexible tape member 5 of a predetermined length is inserted into the slits 2 to form a decorative plate which is available as a "holder" for the tools.

Figure 10:
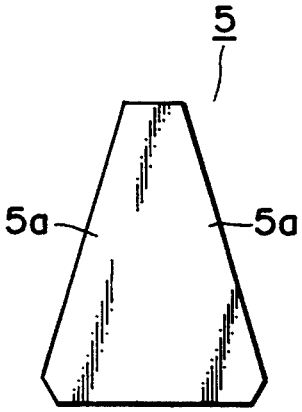
FIG. 10 is a perspective view of a flexible thin tape member shown in FIG. 9.

The present invention can be applied to form modified decorative plates as shown in FIGS. 6 to 10. In an embodiment of FIG. 6, opposite ends of the flexible thin tape member 5 are inserted into confronting spaced slits 2 so that the tape member 5 is extended above the substrate surface in a curved configuration as illustrated. In a further embodiment of FIGS. 7 and 8, a flexible tape member 5 is formed with extended portions **5*a* formed as shown by phantom lines in FIG. 8 and the extended portions 5*a* are bent along the phantom lines and inserted into the slits 2 of the substrate 1. In a further modification of the invention shown in FIGS. 9 and 10, a flexible tape member 5 is formed into a substantially trapezoidal shape as shown in FIG. 10, and then the extended portions 5***a* of the trapezoidal tape member 5 are inserted into the slits 2 of tapered configuration so that a cone shaped "bag" is formed on the surface of the substrate 1.

According to the present invention, a substrate of a foamed plastic plate is prepared, slits of a predetermined figure and pattern are formed on the substrate and the slits are widened for receiving a part of a flexible thin tape member so that the tape member is held by the slits. Thus a three-dimensional decorative plate of three-dimensional pattern can be obtained. In the present invention, the flexible thin tape member preferably has an extending portion extending along a length of the tape member so that only the extended portion is inserted into and held by the slits. If one extending portion of the tape member is inserted into one slit while the other extending portion thereof is inserted into the other slits, the tape member is curved above the plane of the substrate to thereby form a curved extended portion of three-dimensional patterns.

What is claimed is:

1. A method of producing a decorative plate, comprising the steps of:

supplying a substrate of a foamed plastic plate, having elastic properties, forming slits depicting a pattern, widening an opening of the slits, and inserting an edge portion of a flexible thin tape member into the widened slits of the pattern to thereby permit the edge portion of the tape member to be held in the slits by elasticity of the slits, wherein the edge portion of the tape member is engaged within the slits and a remaining portion of the tape member extends above the substrate to form a three-dimensional pattern on the plate.

2. A method of producing a decorative plate according to claim 1, in which said flexible thin tape member has an elongated edge portion extending along a length of said tape member, wherein only the elongated edge portion is inserted into and held by said slits.

* * * * *